United States Patent [19]

Ganyard

[11] 4,350,853

[45] Sep. 21, 1982

[54] ALARM TOE SWITCH

[75] Inventor: Floyd P. Ganyard, Albuquerque, N. Mex.

[73] Assignee: The United States of America as represented by the Department of Energy, Washington, D.C.

[21] Appl. No.: 208,099

[22] Filed: Nov. 18, 1980

[51] Int. Cl.[3] ..... H01H 9/00

[52] U.S. Cl. ..... 200/52 R; 335/205; 340/574

[58] Field of Search ..... 335/205; 200/52 R, DIG. 2, 200/84 C, 85 R, 85 A, 86 R, 86 A, 86.5; 340/574, 573, 365 L

[56] References Cited

U.S. PATENT DOCUMENTS

| | | | |
|---|---|---|---|
| 1,658,848 | 2/1928 | Kalikow | 340/541 |
| 1,771,258 | 7/1930 | Kalikow et al. | 340/574 X |
| 2,780,693 | 2/1957 | McClellan | 200/86 |
| 3,012,116 | 12/1961 | Boylan et al. | 335/205 |
| 3,445,796 | 5/1969 | Spiroch et al. | 335/205 |
| 3,777,086 | 12/1973 | Riedo | 200/52 R |
| 3,792,389 | 2/1974 | Murphy | 335/205 |
| 4,005,296 | 1/1977 | Olson | 200/85 R |
| 4,048,850 | 9/1977 | Ramberg | 73/133 R |

*Primary Examiner*—Arthur T. Grimley
*Assistant Examiner*—Morris Ginsburg
*Attorney, Agent, or Firm*—George H. Libman; Albert Sopp; Richard G. Besha

[57] ABSTRACT

An alarm toe switch inserted within a shoe for energizing an alarm circuit in a covert manner includes an insole mounting pad into which a miniature reed switch is fixedly molded. An elongated slot perpendicular to the reed switch is formed in the bottom surface of the mounting pad. A permanent cylindrical magnet positioned in the forward portion of the slot with a diameter greater than the pad thickness causes a bump above the pad. A foam rubber block is also positioned in the slot rearwardly of the magnet and holds the magnet in normal inoperative relation. A non-magnetic support plate covers the slot and holds the magnet and foam rubber in the slot. The plate minimizes bending and frictional forces to improve movement of the magnet for reliable switch activation. The bump occupies the knuckle space beneath the big toe. When the big toe is scrunched rearwardly the magnet is moved within the slot relative to the reed switch, thus magnetically activating the switch. When toe pressure is released the foam rubber block forces the magnet back into normal inoperative position to deactivate the reed switch. The reed switch is hermetically sealed with the magnet acting through the wall so the switch assembly S is capable of reliable operation even in wet and corrosive environments.

7 Claims, 7 Drawing Figures

Fig. 3
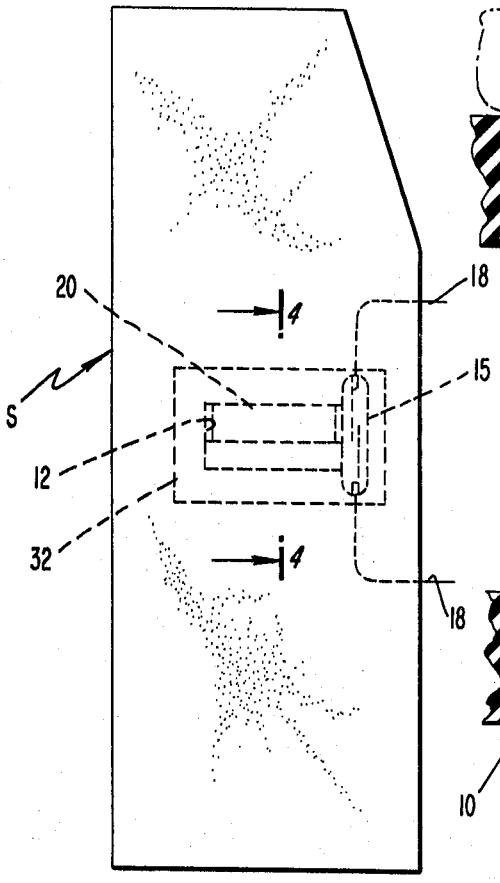
Fig. 4
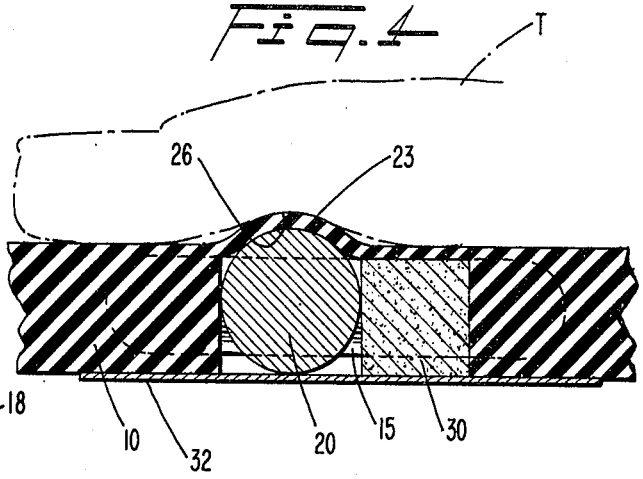
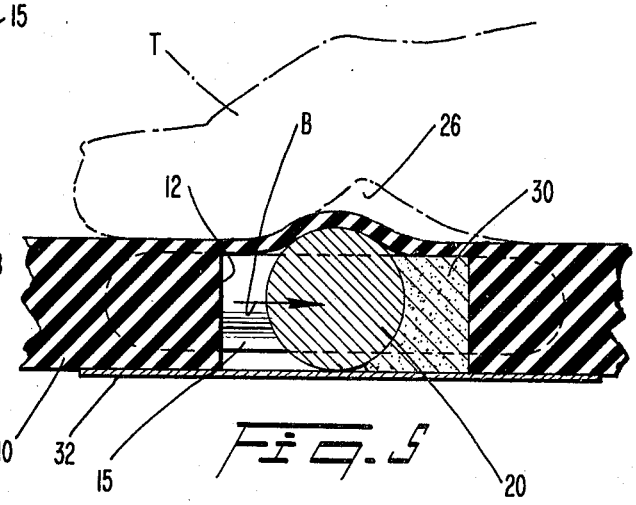
Fig. 5
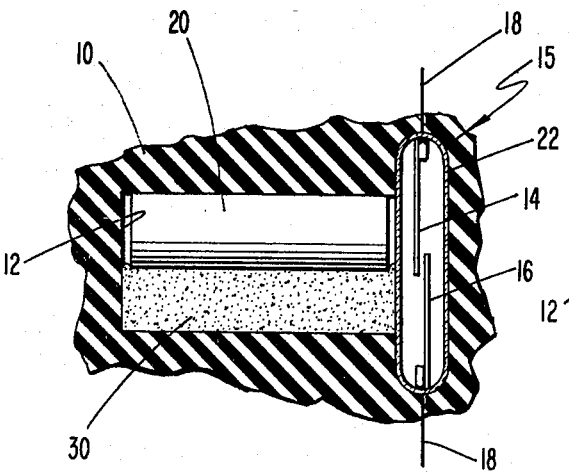
Fig. 6
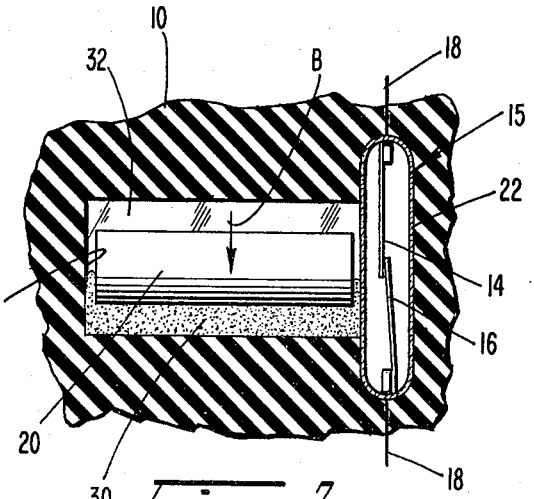
Fig. 7

ALARM TOE SWITCH

BACKGROUND OF THE INVENTION

This invention generally relates to toe activated switches for consciously and inconspiciously signaling duress, and more particularly, to a moisture and shock resistant toe switch capable of activating an alarm circuit in a covert manner by movement of the big toe and without causing false alarms.

Prior art toe switches are known for use in activating alarm circuits in a covert manner. One such switch is disclosed in the prior U.S. Pat. No. 3,777,086 of Riedo wherein a switch is built into a shoe or sweat absorbent liner and includes a moving metal part that slides toward another metal part to make electrical contact. The moving metal part is mounted to a flexible membrane material in the region of the balls of the toes and is movable by flexing the toes. The metal parts are not effectively sealed and if wet could give a false alarm. Also, the metal parts are subject to corrosive influences and may not make proper contact when such electrical contact is desired. The constant presence of the movable metal part directly under the balls of the toes can also provide uncomfortable for the wearer and normal flexing of the toes can lead to a higher incidence of false alarms. In addition, in the Riedo device since sliding movement of the metal part must be induced by a force including downward pressure exerted by the toes, sliding movement occurs only after overcoming the substantial forces generated between the liner and the metal plate. Also, the frictional forces induced by toe pressure for activating an alarm circuit can be to some degree dependent upon the amount of wetness in the shoe. This can render the switch inoperative due to excessive slippage between the toe and the membrane, i.e. increase the incidence of false alarms due to uncontrolled slippage between the metal parts. In some instances of high moisture content, the friction between the metal parts of the switch may be insufficient to even counter frictional forces normally occuring during walking.

Other prior art switches use pressure devices or sensors attached to the body to monitor vital signs, such as heartbeat, which signals are sometimes prone to giving false alarms. In some cases, such sensors attached to the body are bothersome and uncomfortable to the wearer.

SUMMARY OF THE INVENTION

It is accordingly an object of the present invention to provide a toe switch operable in a covert manner to sound an alarm.

Another object of the invention is to provide an alarm toe switch capable of reliable operation in wet, corrosive, and otherwise hostile environments.

Yet, another object is to provide an alarm toe switch comfortable to the wearer.

Still, another object is to provide an alarm toe switch that is easily activated by backward toe pressure, yet is not subject to involuntary activation.

Additional objects, advantages, and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

The alarm toe switch of the present invention is capable of covertly signalling duress and comprises magnetically activated switch means, such as a miniature reed switch, for activating an alarm circuit. The switch is activated by magnet means, in the form of a permanent cylindrical magnet. The magnet and miniature reed switch are normally positioned inoperatively in relation to each other; however, displacement of the magnet caused by backward pressure of the big toe, in relation to the reed switch, magnetically activates the reed switch and energizes the alarm circuit. Spring means, such as a foam rubber block or strip, is positioned rearwardly of the magnet and holds the magnet in normal inoperative relation to the reed switch to prevent undesired activation. The spring means is operable to return the magnet to its normal inoperative position for deactivating the switch means when the toe pressure is relaxed.

Preferably, the reed switch, magnet and spring means are housed in insole mounting pad means. The switch is sealed completely in a capsule. One end of the magnet activates the switch through the non-metallic wall of the capsule. A slot in the mounting pad securely houses the magnet and spring means. The magnet protrudes above a flat surface of the mounting pad and, with the pad securely positioned beneath the big toe, creates a slight bump projection in the knuckle space. By this arrangement, rearward big toe movement provides switch activation displacement of the magnet. The rearward magnet movement by the toe compresses the spring block storing energy to return the magnet once the pressure is released.

The alarm toe switch may further comprise a non-magnetic metal plate secured to the bottom surface of the mounting pad and covering the slot to provide mechanical support for the switch and magnet. Thusly secured, the magnet moves in the slot when subjected to toe pressure without encountering substantial frictional, magnetic or bending forces preventing such movement.

BRIEF DESCRIPTION OF THE DRAWING

FIG. 3 is an enlarged top plan view of the alarm toe switch assembly shown in FIG. 2;

FIG. 4 is an enlarged partial, sectional view taken along the line 4—4 of FIG. 3, showing the positioning of the magnet and spring means in relation to the big toe;

FIG. 5 is a side sectional view similar to FIG. 4 showing rearward movement of the magnet by toe pressure for activating the alarm circuit;

FIG. 6 is an enlarged, partial bottom plan view of the alarm toe switch assembly showing the operative positioning of the magnet and spring means within the slot in relation to the capsulated reed switch; and FIG. 7 is similar to FIG. 6 and illustrates activation of the reed switch by rearward movement of the magnet.

DETAILED DESCRIPTION OF THE INVENTION

Figure 1:
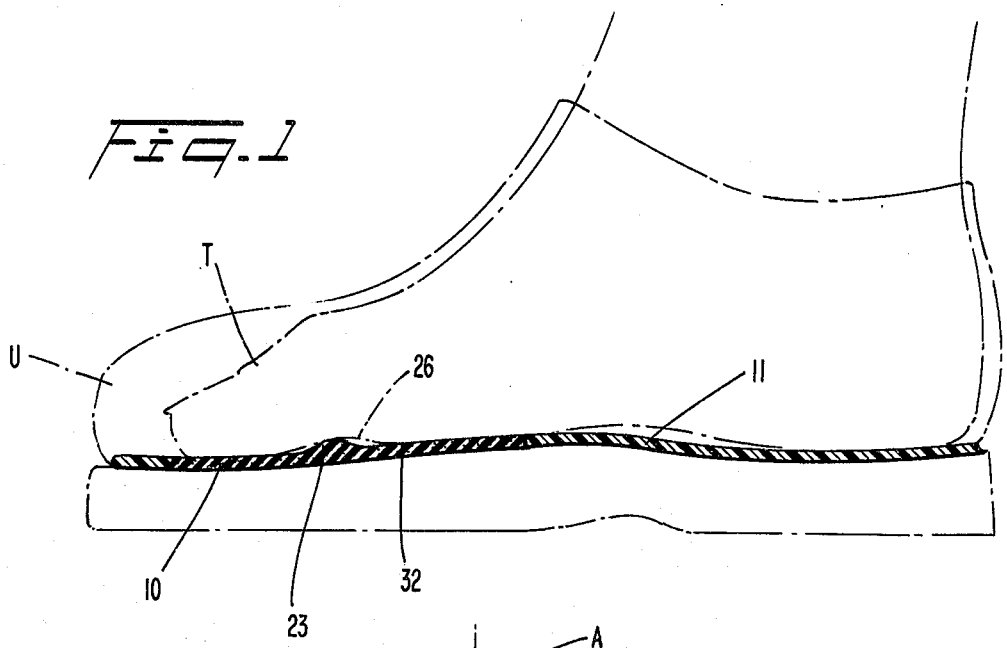
FIG. 1 is a side view of a shoe containing the alarm toe switch to signal covert duress illustrating the positioning of the mounting pad and magnet in relation to the knuckle space of the big toe.
Figure 2:
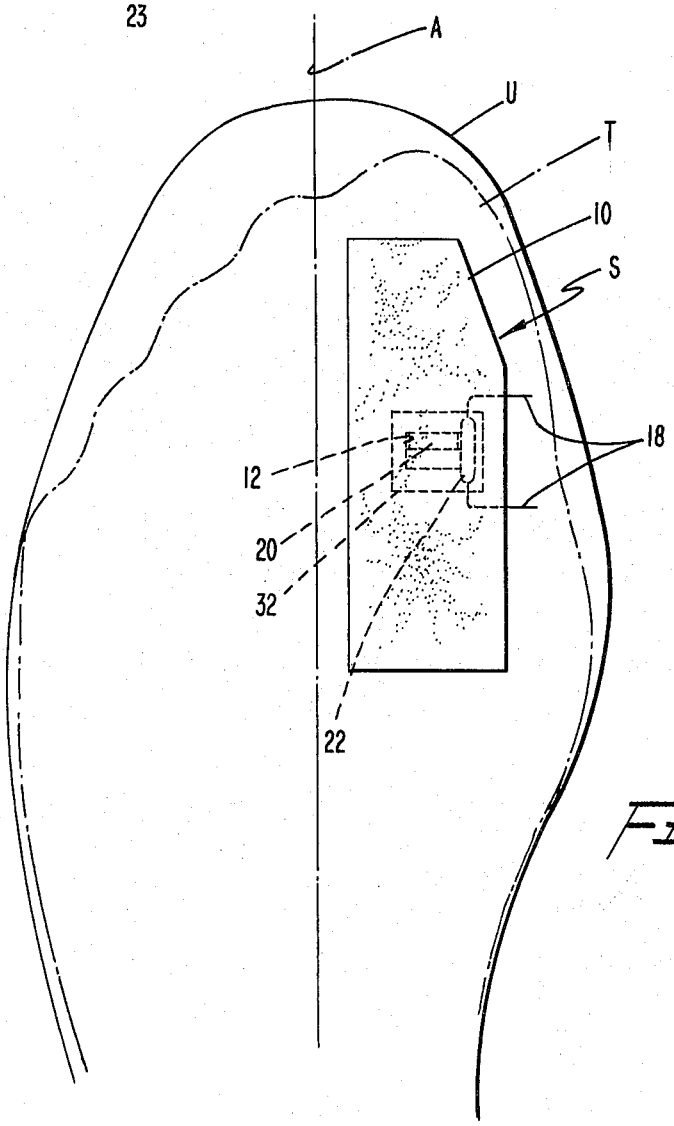
FIG. 2 is a top plan view of the alarm toe switch placed in the shoe illustrating the positioning of operative elements in relation to the foot.

Reference will now be made in detail to the present preferred embodiment of the invention illustrated in the accompanying drawings. Referring first to FIGS. 1 and 2, toe switch assembly S is shown mounted in a shoe U in position beneath big toe T. Alarm toe switch assembly S comprises insole pad mounting means, which preferably includes a substantially flat rubber or plastic insole mounting pad 10 having top and bottom flat surfaces. Pad 10 is mounted directly within a cutout of insole 11 in shoe U, or in a Doctor Scholl's type foot pad (not shown). Mounting pad 10 includes an elongated slot 12, as best shown in FIG. 6, formed substantially perpendicular to insole longitudinal axis A in the bottom surface.

A miniature reed switch 15, is preferably molded into mounting pad 10 perpendicular to slot 12 (FIG. 2) and is connected to an alarm circuit (not shown) by wire leads 18. In normally open position, shown in FIG. 6, magnetic contact strips 14, 16 do not contact each other and the alarm circuit remains inoperative. By subjecting reed switch 15 to a magnetic field, contact strips 14, 16 contact each other (FIG. 7) and the alarm circuit is energized. Reed switch 15 has been found particularly useful in the present preferred embodiment because contact strips 14, 16 are hermetically sealed in a capsule, such as glass envelope 22, and are thus not subject to wet or corrosive influences which many prior art devices are susceptible to. These hostile influences are known to cause false alarms or total failure in prior art devices. Reliable covert activation of an alarm circuit is most critical and the device of the present invention provides the advance in the art necessary for this purpose.

For the purpose of activating reed switch 15 with a magnetic field and energizing the alarm circuit, magnet means are provided in the toe switch assembly S movable by toe displacement. The magnet means is placed in the inoperative position, a forward position in elongated slot 12, as best shown in FIG. 6. Preferably, magnet means include a permanent cylindrical magnet 20 placed in slot 12. The cylindrical axis of the magnet is parallel to the direction of the slot.

As best shown in FIGS. 1 and 4, the diameter of magnet 20 is greater than the thickness of mounting pad 10 creating a bump or projection 23 above the surface of pad 10. Pad 10 is placed upon insole 11 so that bump 23 created by the magnet 20 is positioned within knuckle space 26 of toe T (FIG. 4).

It will be understood that by rearwardly moving (scrunching) toe T, as best shown in FIG. 5, the bump 23 of magnet 20 is contacted, rollably sliding magnet 20 rearwardly in slot 12 in the direction of arrow B (see FIG. 5). This rearward movement of magnet 20 by toe T magnetically influences magnetic contact strips 14, 16 of reed switch 15 (FIG. 7) for activating an alarm circuit or similar desired device.

For the purpose of maintaining magnet 20 in normal inoperative position to reed switch 15 (FIGS. 4 and 6), spring means is placed rearwardly adjacent to magnet 20 in slot 12. Preferably, such spring means includes a block of foam rubber 30 of sufficient size to fill the slot space rearward of magnet 20 when the magnet is in normal inoperative position described above. In addition, it will be understood that after reed switch 15 is activated by pressure from toe T (FIGS. 5 and 7), foam rubber block 30 forces magnet 20 back to normal inoperative position to deactivate the alarm circuit.

For the purpose of providing mechanical support in the area of magnet 20 for ensuring reliable operation of the magnet in slot 12, a non-magnetic support plate 32 (FIG. 4), such as aluminum, is attached to the bottom surface of mounting pad 10, such as by adhesive, covering slot 12 (FIG. 3). Support plate 32 maintains the structural rigidity of slot 12 by preventing bending or excessive frictional forces. This plate 32 assures that the travel of the magnet 20 in the slot 12 is smooth, and capable of precise control.

The mounting pad 10 may be covered with a thin rubber membrane (not shown) for the purpose of increasing comfort to the wearer and minimizing shock and vibrational forces encountered in normal use.

The full advantage of this invention may best be realized by following the operations involved in activating and deactivating the toe switch assembly S. As shown in FIGS. 2 and 4, mounting pad 10 containing the toe switch assembly S is positioned in the insole area of shoe U with the bump 23 of magnet 20 occupying the knuckle space 26 under big toe T (FIGS. 4 and 5). When covert activation of reed switch 15 is necessary, big toe T is scrunched rearwardly (FIG. 5), causing magnet 20 to move rearwardly in the direction of arrow B.

Generally, displacement of magnet 20 of about 1/32 inch closes the switch. A delay of approximately one second may be built into the alarm circuit. This is sufficient to activate reed switch 15 energizing the alarm circuit only when a a clear signal of danger is obtained.

When toe pressure is released, foam rubber block 30 forces magnet 20 to assume its original inoperative position, thus deactivating reed switch 15.

It will be understood that when the magnet 20 is displaced by rearward movement, the magnet 20 tends to roll and slide rearwardly on the support plate 32. Thus, minimal friction is encountered.

Since the reed switch 15 is cradled in pad 10, it is protected from breakage or other damage.

The foregoing description of a preferred embodiment of the present invention has been presented for purposes of illustration and description. It is not intended to be exhaustive or to limit the invention to the precise form disclosed, and obviously, many modifications and variations are possible, in light of the above teachings. For example, the relative displacement between magnet 20 and reed switch 15 for activating the switch may be achieved by fixedly mounting the magnet 20 in mounting pad 10 in a stationary position, with movement imparted to reed switch 15 by the toe T. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims pended hereto.

What is claimed is:

1. A covert duress alarm toe device of unitary construction for insertion within a shoe and activation by toe pressure for covert energization of an alarm circuit comprising:

a substantially flat insole mounting pad having top and bottom surfaces and adapted for placement within a shoe;

a miniature reed switch affixed within said mounting pad, said bottom surface of said pad including a slot substantially perpendicular to and adjacent said switch;

permanent magnet means for operating said reed switch positioned for movement within the slot, said magnet means being of greater thickness than the mounting pad thickness to create a bump above the surface of said mounting pad for facilitating movement of the magnet means by toe pressure from a first position in inoperative relation to said reed switch to a second position in operative relation to said reed switch, whereby the alarm circuit is energized; and spring means positioned in the slot adjacent said magnet for returning said magnet to said first position when toe pressure is removed.

2. The device according to claim 1 wherein said magnet means comprises a permanent cylindrical magnet.

3. The device according to claim 1 wherein said spring means includes a foam rubber block.

4. The device according to claim 1 wherein said mounting pad is a rubber pad and said reed switch is molded in the pad.

5. The device according to claim 1 wherein the movement required for activating said switch is approximately 1/32 of an inch.

6. The device according to claim 1 wherein the reed switch is hermetically sealed with a non-metallic wall so that water or perspiration has no effect and the magnet operates through the wall.

7. The device according to claim 1, further comprising non-magnetic support plate means secured to the bottom surface of said pad covering the slot and said switch to provide mechanical support and improve the sliding action of the magnet in the slot.

* * * * *